US007123987B2

(12) United States Patent
Okamoto et al.

(10) Patent No.: US 7,123,987 B2
(45) Date of Patent: Oct. 17, 2006

(54) ROD MEMBER RECEIVING APPARATUS

(75) Inventors: Hiroshi Okamoto, Tokyo (JP); Syozo Horikawa, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 308 days.

(21) Appl. No.: 10/868,215

(22) Filed: Jun. 16, 2004

(65) Prior Publication Data

US 2004/0221859 A1 Nov. 11, 2004

Related U.S. Application Data

(63) Continuation of application No. PCT/JP03/01335, filed on Feb. 7, 2003.

(30) Foreign Application Priority Data

Feb. 27, 2002 (JP) ..... 2002-051663

(51) Int. Cl.
*G06F 7/00* (2006.01)

(52) U.S. Cl. ..... 700/213; 198/438; 198/428; 198/471.1

(58) Field of Classification Search ..... 700/213; 198/380, 428, 438, 456, 471.1, 478.1, 493
See application file for complete search history.

(56) References Cited

U.S. PATENT DOCUMENTS 4,883,449 A * 11/1989 Heaney et al. ..... 493/43
5,607,043 A * 3/1997 Irikura ..... 198/438
5,657,850 A * 8/1997 Suzuki et al. ..... 198/438
5,695,441 A * 12/1997 Irikura ..... 493/47
5,931,278 A 8/1999 Watanabe

FOREIGN PATENT DOCUMENTS

JP 8-33471 A 2/1996
JP 10-14556 A 1/1998

* cited by examiner

*Primary Examiner*—Khoi H. Tran
(74) *Attorney, Agent, or Firm*—Birch, Stewart, Kolasch & Birch, LLP

(57) ABSTRACT

A receiving apparatus for a filter cigarette making machine comprises a rotatable catcher drum (2). The drum (2) has receiving grooves (6) in its outer circumferential surface, for each receiving a cigarette rod (CR). A rod (CR) received in the groove (6) moves forward into a braking area therein. In the braking area, the rod (CR) receives braking force due to suction and is stopped. A pair of limit sensors (40, 42) are arranged outside the drum (2). The sensors (40,42) optically detect a rear end of the rod (CR), and on the basis of the result of this detection, whether a stop position at which the rod is stopped is within a tolerance area or not is determined. On the basis of the result of this determination, a controller (38) regulates the braking force exerted on rods (CR) to thereby control the stop position of the rods (CR). Then, a pusher (26) pushes the rod (CR) from its stop position back to a normal position, in each of the grooves (6).

9 Claims, 10 Drawing Sheets

ROD MEMBER RECEIVING APPARATUS

This application is a Continuation of copending PCT International Application No. PCT/JP03/01335 filed on Feb. 7, 2003, which designated the United States, and on which priority is claimed under 35 U.S.C. § 120. This application also claims priority under 35 U.S.C. § 119(a) on Patent Application No(s). 2002-051663 filed in Japan on Feb. 27, 2002. The entire contents of each of the above documents are hereby incorporated by reference.

TECHNICAL FIELD

The present invention relates to a rod member receiving apparatus, particularly a receiving apparatus suitable as a cigarette rod receiving apparatus in a filter cigarette making machine.

BACKGROUND ART

A filter cigarette making machine has a predetermined conveying path, and cigarette rods are supplied to the conveying path and carried along the carrying path. While carried along the conveying path, each cigarette rod is cut into two equal parts to form two cigarettes.

Then, on the conveying path, a cigarette/plug assembly having a filter plug arranged between two cigarettes is formed. By wrapping a piece of tip paper around the cigarette/plug assembly,. the cigarette/plug assembly is formed into a double filter cigarette. Then, by cutting the double filter cigarette at the center of the filter plug, individual filter cigarettes are obtained.

Generally, a filter cigarette making machine has a drum train, and the drum train forms the conveying path. More specifically, the drum train includes a plurality of grooved drums, and the grooved drums are arranged in line, adjacent to each other. The grooved drum at the beginning end of the drum train is called a catcher drum. The catcher drum is disclosed in Japanese Unexamined Patent Publication No. hei 10-14556, for example.

The catcher drum disclosed in this publication has a plurality of receiving grooves in an outer circumferential surface thereof. The receiving grooves are arranged at regular intervals in the circumferential direction of the catcher drum. As the catcher drum rotates, the receiving grooves pass a receiving position one after another. The receiving position is defined as a predetermined angle position in the direction of rotation of the catcher drum.

When each receiving groove passes the receiving position, a cigarette rod is fed into the receiving groove and received in the receiving groove. The cigarette rod received in the receiving groove moves forward in the groove. While moving forward, braking force from a braking means is applied to the cigarette rod so that the cigarette rod stops at a predetermined position in the receiving groove.

Specifically, the braking means comprises a plurality of suction holes open at the bottom of each receiving groove and a suction source for supplying suction pressure to the suction holes, and the suction pressure brakes the cigarette rod moving forward in the receiving groove.

The cigarette rod in the receiving groove is then pushed back to a normal position by a pusher and placed at the normal position. As a result, the cigarette rod is surely transferred from the catcher drum onto the next grooved drum, which is a transfer drum, and carried along the conveying path.

The position at which the cigarette rod is stopped in the receiving groove by the braking means varies to a large degree even when the speed at which the cigarette rod is fed or the weight of the cigarette rod varies slightly.

Thus, when the cigarette rod is stopped in the receiving groove after overrunning the normal position to a large degree, not only the distance that the cigarette rod slides increases but also the distance that the cigarette rod is pushed back, namely the distance between the position at which the cigarette rod is stopped and the normal position increases. In this situation, the cigarette rod rubs against the inner surface of the receiving groove, and wrinkles are easily formed on the wrapping paper of the cigarette rod.

Meanwhile, when the cigarette rod is stopped in the receiving groove before reaching the normal position, the pusher cannot push back the cigarette rod to the normal position. As a result, the cigarette rod cannot be transferred from the catcher drum to the transfer drum, hence cannot be carried along the conveying path.

DISCLOSURE OF THE INVENTION

An object of the invention is to provide a rod member receiving apparatus that can receive rod members in receiving grooves without damaging the rod members and ensure that the rod members are carried stably.

In order to achieve the above object, a receiving apparatus for receiving rod members according to the invention comprises a catcher drum forming a beginning end of a conveying path and rotatable in one direction, the catcher drum having a plurality of receiving grooves in an outer circumferential surface thereof, arranged in the circumferential direction of the catcher drum at regular intervals, and a receiving position located at a predetermined position in the circumferential direction of the catcher drum and to which rod members are fed, the receiving grooves being so designed as to each receive a rod member at the receiving position when the catcher drum rotates and the receiving grooves pass the receiving position one after another, and allow the received rod member to move forward in the receiving groove; braking means for stopping the forward movement of the rod member in each of the receiving grooves, the braking means including braking areas each defined at a bottom of each receiving grooves to apply predetermined braking force due to suction onto the rod member when the rod member enters the braking area; detection means for detecting whether a stop position at which the rod member is stopped in each of the receiving grooves is within a tolerance area or not, and feeding a result of detection; control means for regulating the braking force by the braking means on the basis of the result of detection to thereby control the stop position of rod members; and positioning means for, after the rod member is stopped in each of the receiving grooves, pushing the rod member from the stop position back to a normal position, in the direction opposite to the direction of the forward movement, on the conveying path.

In this receiving apparatus, when the stop position of a rod member is out of the tolerance area, this situation is detected by the detection means. On the basis of the result of detection by the detection means, the braking force exerted on the rod member by the braking means is increased or decreased. Specifically, when a rod member overruns the tolerance area and stops, the braking force is increased. When a rod member runs short and stops behind the tolerance area, the braking force is decreased. As a result, the stop position at which the rod members are stopped in each of the receiving grooves is automatically brought back to within the tolerance area.

When the stop position of rod members is kept within the tolerance area like this, the distance that the rod members slide and the distance that the rod member are pushed back in each of the receiving grooves are kept short, so that the risk of rod members being damaged is reduced. Further, this enables effective positioning of rod members and ensures the stable transfer of rod members.

Specifically, the detection means includes a pair of limit sensors arranged outside the catcher drum for optically detecting the rod member. These limit sensors are apart from each other in the direction of the forward movement of the rod member, and define the tolerance area.

Desirably, the paired limit sensors are arranged to detect an end part of the rod member.

In this case, if neither of the paired limit sensors can detect a rear end part of the rod member, it means that the rod member has overrun the tolerance area. Meanwhile, if both of the paired limit sensors detect the rear end part of the rod member, it means that the rod member has run short with reference to the tolerance area.

If only the limit sensor located ahead in the direction of the forward movement of the rod member detects the rear end part of the rod member, it means that the rod member is stopped in the tolerance area. In this case, the braking force is kept unchanged.

The control means can comprise reading means for reading sensor signals from the paired limit sensors; determination means for determining whether the stop position of a rod member is within the tolerance area or not, on the basis of the sensor signals; means for sending out a removal signal for removing the rod member from the conveying path, on the basis of the result of determination by the determination means; sampling means for sampling and classifying results of determination by the determination means; and regulation means for increasing or decreasing the braking force exerted on the rod members on the basis of the result of classification by the sampling means, each time the number of sampled results reaches a predetermined value. Specifically, the sampling means may classify the results of determination into two groups. The stop position of one group is out of the tolerance area in one direction and the stop position of the other group is out of the tolerance area in the other direction.

In this case, the control means continues sending out a removal signal for removing the rod member, until the stop position of rod members is brought back to within the tolerance area by regulation of the braking force.

The detection means can further include a pair of intermediate sensors arranged outside the catcher drum for optically detecting a rod member. The intermediate sensors are apart from each other in the direction of the forward movement of the rod member, and define, within the tolerance area, a target area in which the rod member should be stopped.

In this case, the control means can comprise reading means for reading sensor signals from the paired limit sensors and the paired intermediate sensors; first determination means for determining whether the stop position of the rod member is within the tolerance area or not, on the basis of the signals from the paired limit sensors; means for sending out a removal signal for removing the rod member from the conveying path, on the basis of the result of determination by the first determination means; second determination means for determining whether the stop position of the rod member is within the target area or not, on the basis of the signals from the paired intermediate sensors; sampling means for sampling and classifying results of determination by the first and second determination means; and regulation means for increasing or decreasing the braking force exerted on rod members on the basis of the result of classification by the sampling means, each time the number of sampled results reaches a predetermined value.

The sampling means of this case may classify the results of determination by the first and second determination means into two groups. The stop position of one group is out of the target area in one direction and the stop position of the other group is out of the target area in the other direction.

With this control means, when the stop position of rod members tends to be out of the tolerance area, the braking force exerted on rod members is regulated, so that the stop position of rod members is brought back to within the target area. Hence, the stop position of rod members is controlled finely, and the number of rod members removed from the conveying path is much reduced.

The braking areas of the braking means each have a plurality of suction holes open at the bottom of each receiving grooves, to which suction pressure is supplied. The suction holes are distributed in the direction of the forward movement of the rod member.

The catcher drum can further comprise assist means for assisting the rod member to move forward in each of the receiving grooves. This assist means generates a flow of air flowing in the direction of the forward movement of the rod member, in each of the receiving grooves. This assist means stabilizes the forward movement of rod members, so that the rod members are prevented from becoming jammed in the receiving grooves.

BEST MODE OF CARRYING OUT THE INVENTION

Figure 1:
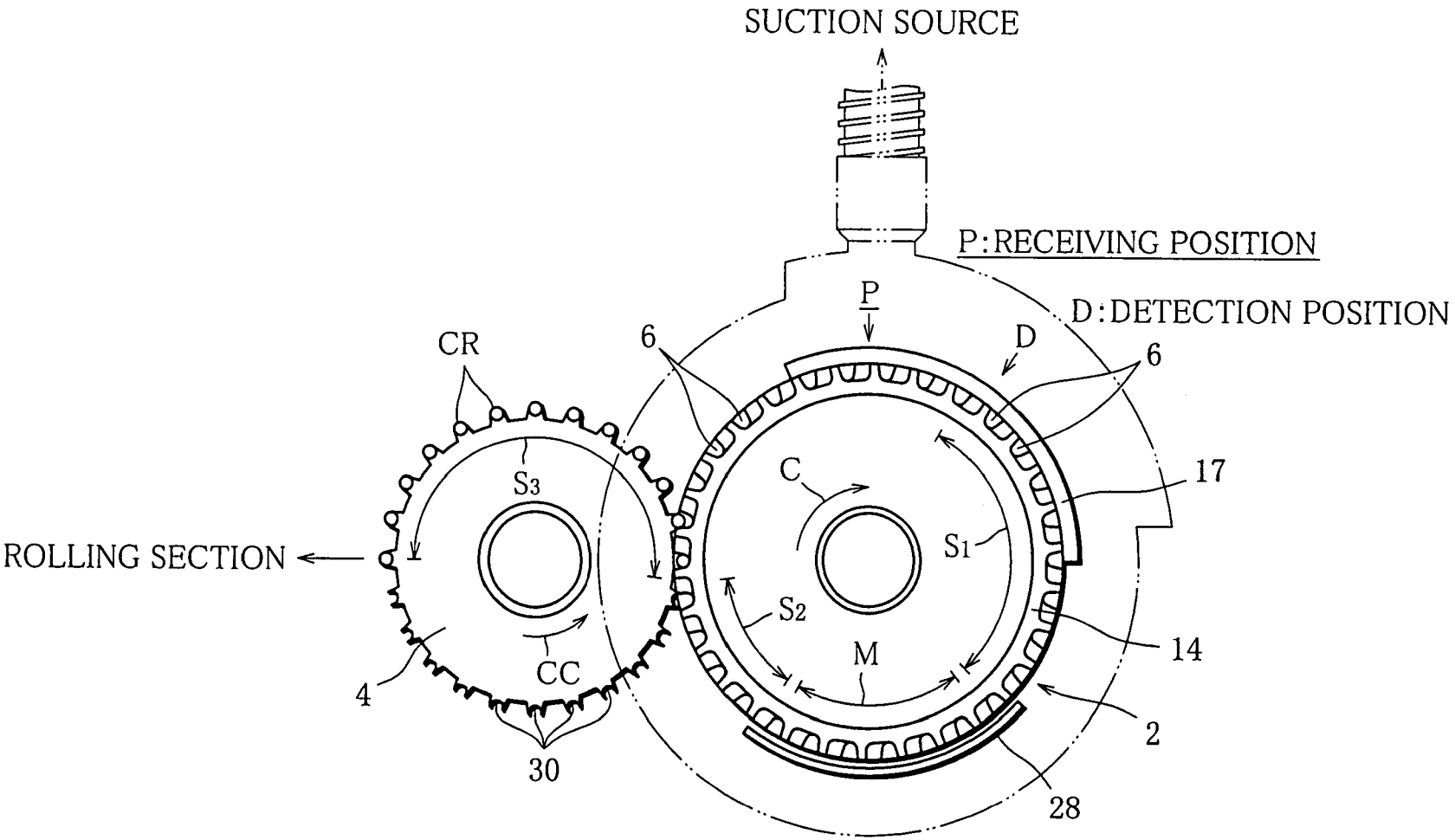
FIG. 1 is a front view showing a catcher drum and a transfer drum of a filter cigarette making machine.

FIG. 1 shows a beginning part of a drum train of a filter cigarette making machine. The drum train comprises a plurality of grooved drums. The grooved drums are arranged in line, adjacent to each other. Any of the grooved drums rotates in a direction opposite to the direction in which a grooved drum adjacent thereto rotates. The drum train thus forms a conveying path along which cigarette rods are carried.

The beginning part of the drum train includes two grooved drums, namely a catcher drum 2 and a transfer drum 4. The catcher drum 2 has a plurality of receiving grooves 6 in an outer circumferential surface thereof. The receiving grooves 6 are arranged at regular intervals in the circumferential direction of the catcher drum 2. Each of the receiving grooves 6 extends in the axial direction of the catcher drum 2, and has an inlet that is open at an end face of the catcher drum 2 and a closed end.

As the catcher drum 2 rotates, the receiving grooves 6 pass a receiving position P one after another. The receiving position P is defined as a twelve o'clock position seen in the circumferential direction of the catcher drum 2. The catcher drum 2 is rotated in the direction of an arrow C, namely clockwise in FIG. 1.

When each receiving groove 6 passes the receiving position P, a cigarette rod CR (hereinafter referred to simply as a rod CR) is fed through the inlet of the receiving groove 6 into the receiving groove 6, so that the receiving groove 6 can receive the rod CR.

More specifically, rods CR are fed towards the catcher drum 2 by a kicker (not shown) of the cigarette making machine at intervals. The direction in which each rod CR is fed coincides with the axial direction of the rod CR. Further, the width of an inlet part of each receiving groove 6 increases toward the inlet, and when each rod CR is fed, each rod CR is given by the kicker a motion component in the direction of rotation of the catcher drum 2. As a result, each receiving groove 6 can surely receive a rod CR.

A rod CR received in a receiving groove 6 moves forward, namely toward the closed end of the receiving groove 6, being guided by the receiving groove 6. When the rod CR moving forward enters a braking area of the receiving groove 6, the rod CR receives suction pressure, namely braking force in the braking area, so that the forward movement of the rod CR is stopped. The braking area is located on the closed-end side of each receiving groove 6.

Before entering into a detailed description of the braking area, first the structure of the catcher drum 2 will be described briefly.

Figure 2:
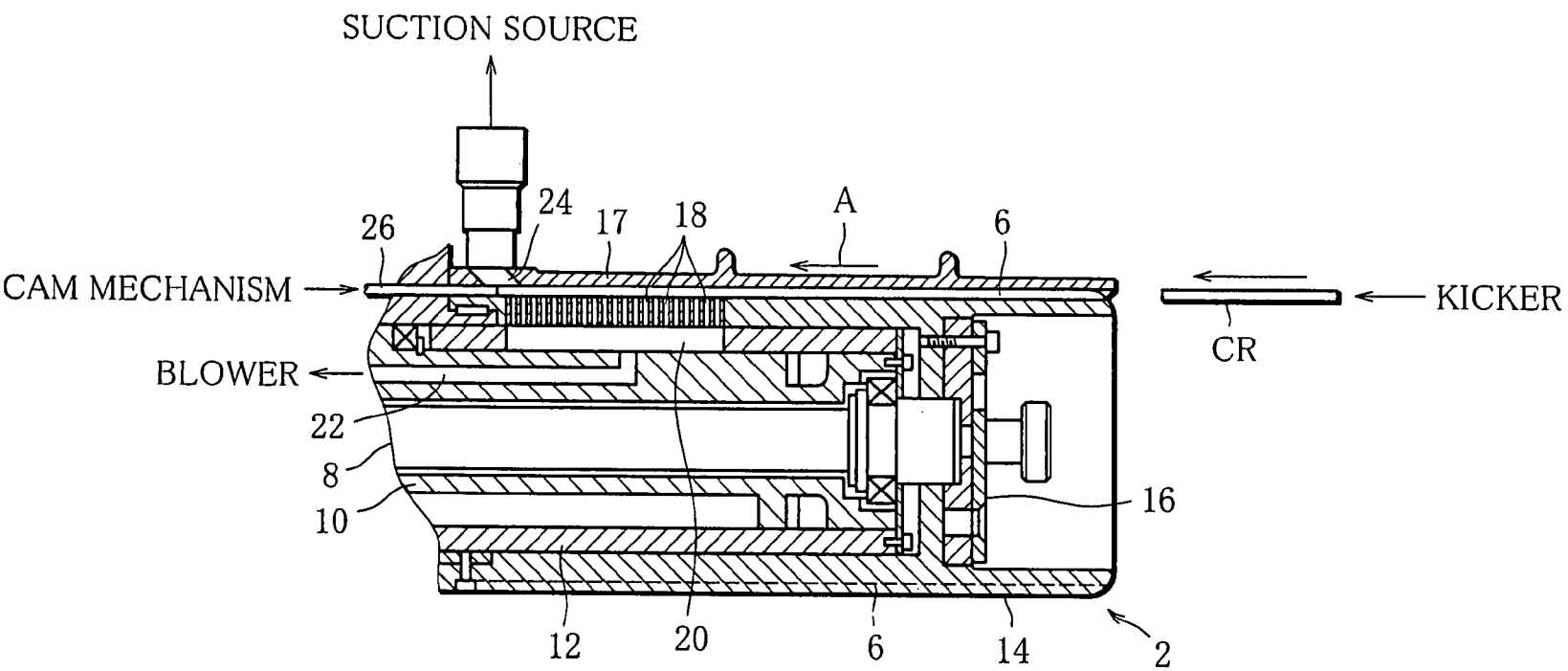
FIG. 2 shows a longitudinal section of the catcher drum of FIG. 1.

As shown in FIG. 2, the catcher drum 2 has a stationary sleeve 10, a control sleeve 12 and a drum shell 14 outside a drive shaft 8. The stationary sleeve 10, the control sleeve 12 and the drum shell 14 are concentrically arranged in this order from the drive shaft 8.

The receiving grooves 6 are formed in the outer circumferential surface of the drum shell 14, and the drum shell 14 is joined to the drive shaft 8 by means of a connector disk 16. Thus, the drum shell 14 rotates with the drive shaft 8 in an integrated manner. Meanwhile, the stationary sleeve and the control sleeve 12 are connected together and cannot rotate when the drive shaft 8 and drum shell 14 rotate.

Outside the drum shell 14 is arranged an arc-shaped shell cover 17. The shell cover 17 covers a part of the circumference of the drum shell 14. Specifically, as seen in FIG. 1, the shell cover 17 extends along the circumference of the catcher drum 2 starting from a position a little upstream the receiving position P in the direction of rotation of the drum shell 14, and covers about a quarter of the circumference of the catcher drum 14.

When a receiving groove 6 goes inside the shell cover 17 with rotation of the drum shell 14, the receiving groove 6 forms a tunnel with the shell cover 17.

The above-mentioned braking area has a plurality of suction holes 18. The suction holes 18 are arranged at predetermined intervals in the direction in which the receiving groove 6 extends. An end of each suction hole 18 is open at the bottom of the receiving groove 6 and the other end is open at the inner circumferential surface of the drum shell 14.

The control sleeve 12 has a suction slot 20 formed to correspond to each braking area in the axial direction thereof. The suction slot 20 extends in the circumferential direction of the drum shell 14 to form a suction area $S_1$. Specifically, when seen in the direction C of rotation of the drum shell 14, the suction area $S_1$ begins at a position which is inside the shell cover 17 and downstream of the receiving position P, and terminates at a position outside the shell cover 14.

When a receiving groove 6 enters the suction area $S_1$ with rotation of the catcher drum 14, the suction holes of the receiving groove 6 are connected to the suction slot 20.

In the stationary sleeve 10 is formed a suction passage 22. The suction passage 22 extends in the axial direction of the stationary sleeve 10. An end of the suction passage 22 is connected to the suction slot 20 of the control sleeve 20, and the other end of the suction passage 22 is connected to a blower as a negative-pressure source, outside the catcher drum 2. The blower sucks out air from the suction slot 20 through the suction passage 24, so that a predetermined negative pressure, namely a suction pressure is generated in the suction slot 20. This suction pressure is constantly maintained.

In this state, when a receiving groove 6 which has received a rod CR as described above enters the suction area S1 inside the shell cover 17, the suction holes 18 of the receiving groove 6 are connected to the suction slot 20, so that suction pressure is supplied from the suction slot 20 to the suction holes 18. when the rod CR moving forward in the receiving groove 6 enters the braking area, namely the area in which the suction holes 18 are distributed, therefore, the rod CR is braked by the suction pressure from the suction holes 18 and stops before reaching the closed end of the receiving groove 6.

When the rod CR is passing through the suction area $S_1$, the receiving groove 6 is formed like the tunnel with the shell cover 17 as mentioned above. The suction pressure from the suction holes 18 thus acts on the rod CR effectively, so that the braking effect on the rod CR is improved.

As mentioned above, the suction area $S_1$ extends beyond the shell cover 17. Also after coming out of the shell cover 17 with rotation of the drum shell 14, the rod CR is sucked by the braking area of the receiving groove 6, namely the suction holes 18 thereof, and stably held in the receiving groove 6.

Further, as shown in FIG. 2, a sucking-out slot 24 is formed in the shell cover 17. The sucking-out slot 24 is located near the closed end of each receiving groove 6, and extends from the receiving position P in the circumferential direction of the shell cover 17, namely in the direction of rotation of the drum shell 14, over a predetermined rotation angle. The sucking-out slot 24 is connected to a suction source such as a blower by a connecting passage. When the receiving groove 6 goes inside the shell cover 17, the suction source sucks out air from the tunnel-like receiving groove 6. As a result, in the receiving groove 6, a flow of air flowing from the inlet towards the closed end of the receiving groove 6 is generated. This airflow helps the rod CR to move forward in the receiving groove 6. However, the power of the airflow moving the rod forward is not so strong as it can overcome the suction pressure supplied through the suction holes 18, namely the braking force acting on the rod CR.

Further, the catcher drum 2 has rod-like pushers 26 each corresponding to one of the receiving grooves 6. Each pusher 26 projects into its corresponding receiving groove 6, from the closed end toward the inlet thereof. Each pusher 26 is moved from a rest position shown in FIG. 2 to a working position nearer to the inlet of the receiving groove 6 by means of a cam mechanism, and then returns from the working position to the rest position. In other words, each pusher 26 can reciprocate between the rest position and the working position.

Though not specifically shown in FIG. 2, the cam mechanism comprises a stationary cam ring surrounding the drum shell 14 and cam followers each connected to one of the pushers 26, for example. The cam followers are guided in cam grooves in the cam ring.

While a receiving groove 6 is passing though a rotation angle area M in FIG. 1 with rotation of the drum shell 14, the cam mechanism makes a corresponding pusher 26 perform one reciprocating action of the pusher 26. The rotation angle area M is located directly downstream of the suction area $S_1$ in the direction of rotation of the drum shell 14.

After the rod CR comes out of the suction area $S_1$, that is, after the rod CR is freed from suction holding, the pusher 26 is made to reciprocate. Thus, when the pusher 26 is pushed forward, the rod CR already stopped in the receiving groove 6 is pushed back to a normal position nearer to the inlet of the receiving groove 6. In other words, the reciprocating stroke of the pusher 26 places the rod CR at the normal position in the receiving groove 6.

As shown in FIG. 1, a part of the circumference of the drum shell 14 is covered with an arc-shaped guide 28. The guide 28 extends along the rotation angle area M and prevents the rod CR fall off the receiving groove 6 while the receiving groove 6 is passing through the rotation angle area M.

Further, as shown in FIG. 1, the catcher drum 2 has another suction area $S_2$ besides the suction area $S_1$. The suction area $S_2$ extends from the rotation angle area M to directly downstream of the transfer drum 4 (or in other words, directly after a rotating contact point between the catcher drum 2 and the transfer drum 4) in the circumferential direction of the drum shell 4.

Like the suction area $S_1$, the suction area $S_2$ is defined by a suction slot (not shown) formed in the control sleeve 12. This suction slot is connected to the suction passage 22 in a manner separated from the suction slot 20.

After passing through the rotation angle area M, the rod CR placed at the normal position is held in the receiving groove 6 by suction pressure supplied in the suction area $S_2$ and carried stably toward the transfer drum 4.

Then, the rod CR that has reached the transfer drum 4 transfers from the catcher drum 2 onto the transfer drum 4, and is further carried on the transfer drum 4 as the transfer drum 4 rotates.

Like the catcher drum 4, the transfer drum 4 has a rotatable drum shell which forms the circumference of the transfer drum 4, and conveying grooves 30 that can receive rods CR are formed in the outer surface of the drum shell. The conveying grooves 30 are arranged in the circumferential direction of the transfer drum 4 at the same intervals as the receiving grooves 6 are arranged. Further, the drum shell of the transfer drum 4 has the same peripheral speed as the drum shell 14 of the catcher drum 2, and rotates counterclockwise as shown by an arrow CC in FIG. 1.

Therefore, the catcher drum 2 and the transfer drum 4 rotate in the opposite directions to each other, where the receiving grooves 6 meet the conveying grooves 30 at the rotating contact point between the catcher drum 2 and the transfer drum 4, one after another.

As shown in FIG. 1, the transfer drum 4 has a suction area $S_3$ similar to the suction areas $S_1$ and $S_2$ of the catcher drum 2. The suction area $S_3$ extends from the rotating contact point between the catcher drum 2 and the transfer drum 4 to just upstream of a rotating contact point between the transfer drum 4 and the next grooved drum, in the direction CC of rotation of the transfer drum 4. When a rod CR on the catcher drum 2 reaches the transfer drum 4, the rod CR is received from the receiving groove 6 into a conveying groove 30 by suction, and carried on the transfer drum 4 toward the next grooved drum as the transfer drum 4 rotates. It is to be noted that when the receiving groove 6 passes the rotating contact point between the catcher drum 2 and the transfer drum 4, the suction holes 18 of the receiving groove 6 is connected to a groove (not shown) formed in the control sleeve 12 that is open to the atmosphere, so that the sucking force applied to the rod CR by the receiving groove 6 is released.

The rod CR is carried on the adjacent grooved drums one after another, or in other words carried along the conveying path, and fed to a rolling section (not shown). As mentioned above, while carried this way, the rod CR is cut into two equal parts, namely made into two individual cigarettes, and then a filter plug is fed between these cigarettes, so that a cigarette/plug assembly is formed. Then, while the cigarette/plug assembly passes through the rolling section, a piece of tip paper is wrapped around the cigarette/plug assembly, so that the cigarette/plug assembly is formed into a double filter cigarette. Then, by cutting the double filter cigarette at the center of the filter plug, individual filter cigarettes are obtained.

Figure 3:
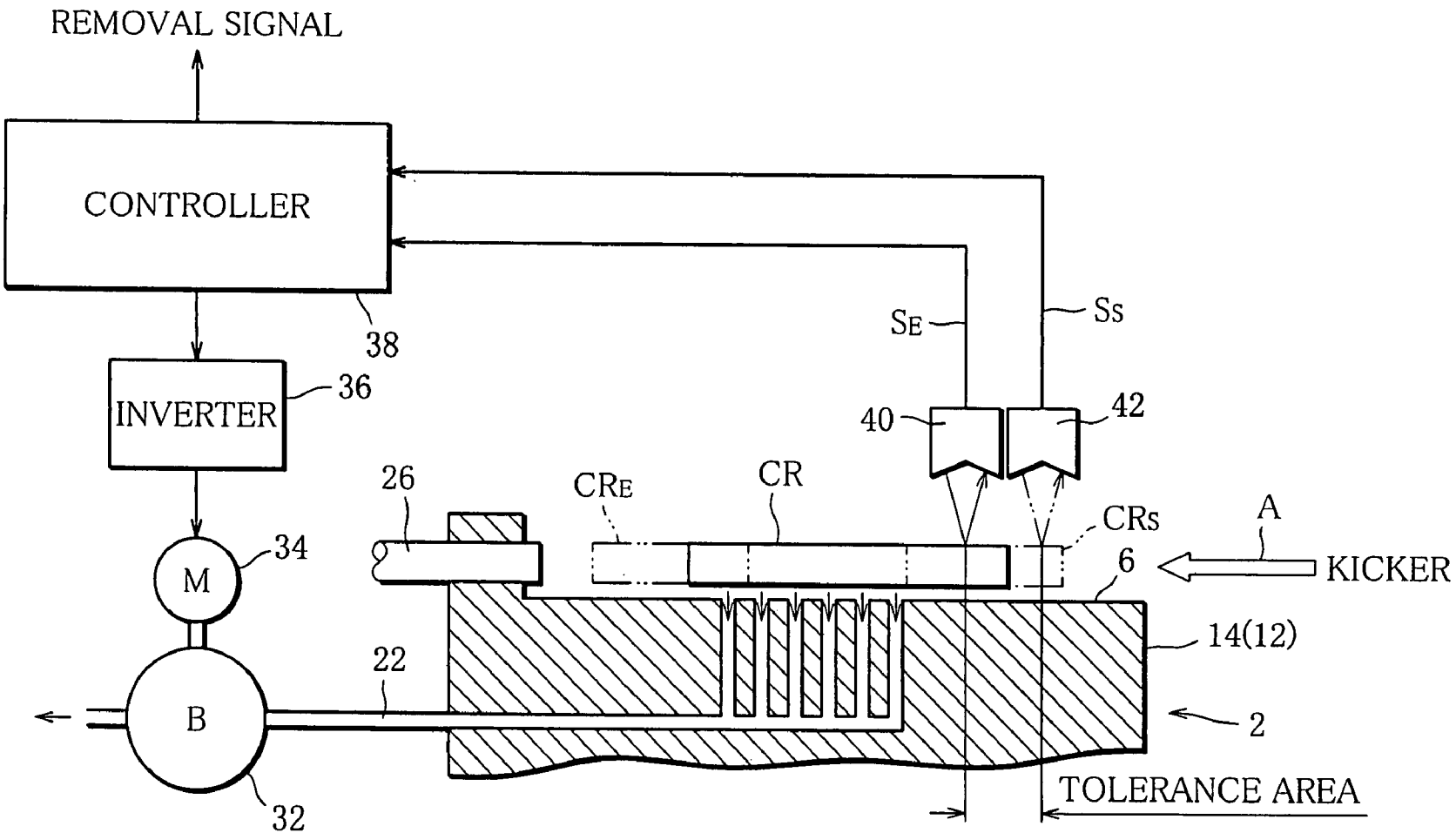
FIG. 3 is a schematic illustration showing an arrangement of a pair of limit sensors relative to the catcher drum and a regulation circuit for regulating suction braking force.

FIG. 3 shows a blower 32 connected to the above-mentioned suction passage 22. The blower 32 is driven by an electric motor 34. The electric motor 34 is electrically connected to an output terminal of a controller 38 with an inverter 36 between.

To input terminals of the controller 38, a pair of limit sensors 40, 42 are electrically connected. The paired limit sensors 40, 42 are reflective optical sensors, for example. As shown in FIG. 3, the paired limit sensors 40, 42 are arranged near the outer circumferential surface of the catcher drum 2, aligned in the longitudinal direction of a receiving groove 6.

The paired limit sensors 40, 42 are located to correspond to an inlet part of each receiving groove 6 to detect a rear end part of the rod CR stopped in each receiving groove 6. Specifically, the paired limit sensors 40 and 42 detect the rear end part of a rod CR at a detection position D (see FIG. 1) in the suction area $S_1$, which is located inside the shell cover 17, and feed sensor signals $S_E$ and $S_S$ to the controller 38, respectively. It is to be noted that when a receiving groove 6 passes the detection position D, forward movement of the rod CR in the receiving groove 6 has been stopped completely.

On the basis of the sensor signals $S_E$ and $S_S$, the controller 38 controls the rotational speed of the electric motor 34 through the inverter 36 and thereby changes the rotational speed of the blower 32. The rotational speed of the blower 32 determines the quantity of air sucked out from the suction slot 20 in the catcher drum 2 through the suction passage 22 or the suction pressure in the suction slot 20. Thus, the braking force exerted on rods CR is controlled by the rotational speed of the blower 32.

Figure 4:
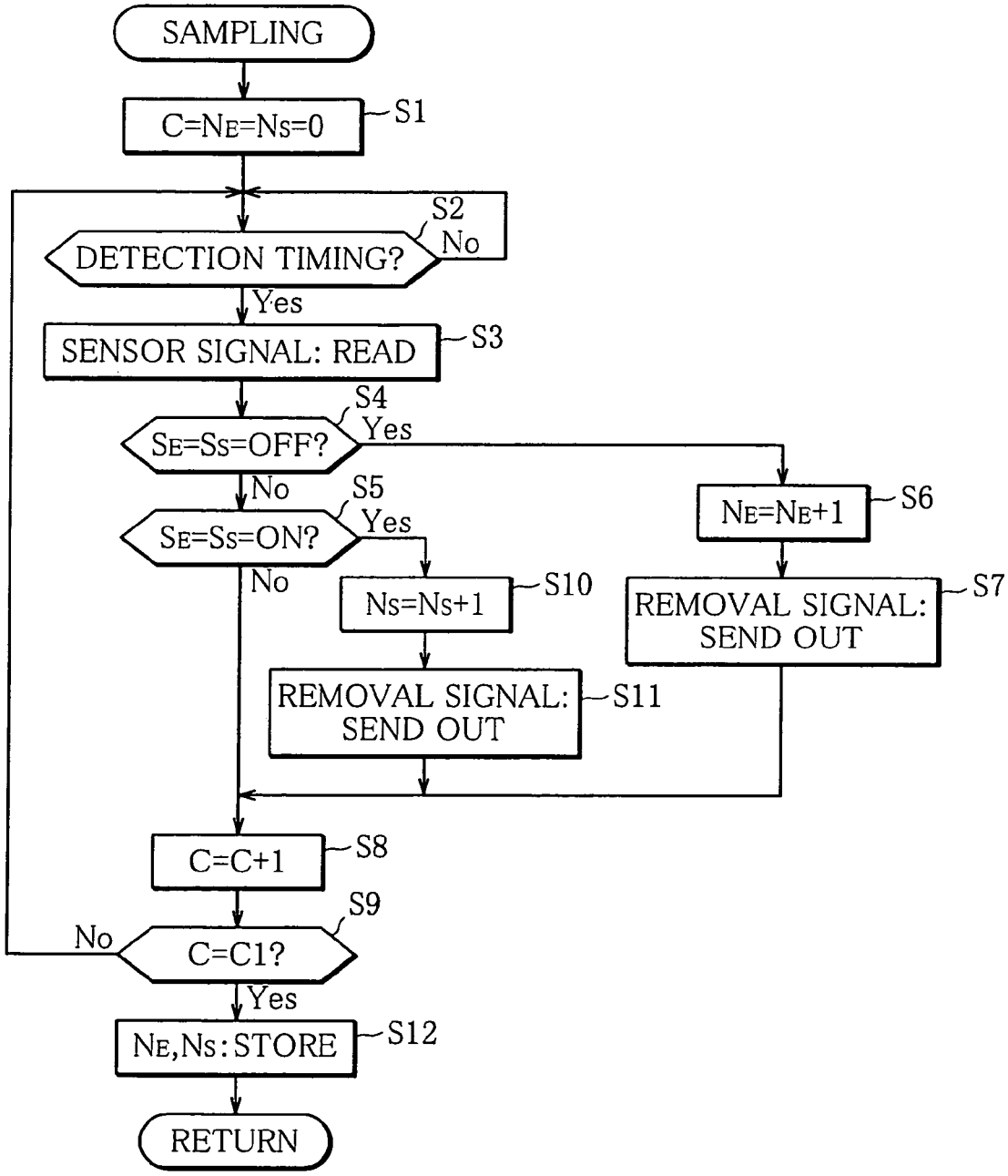
FIG. 4 is a flow chart of a sampling routine using the pair of limit sensors.
Figure 5:
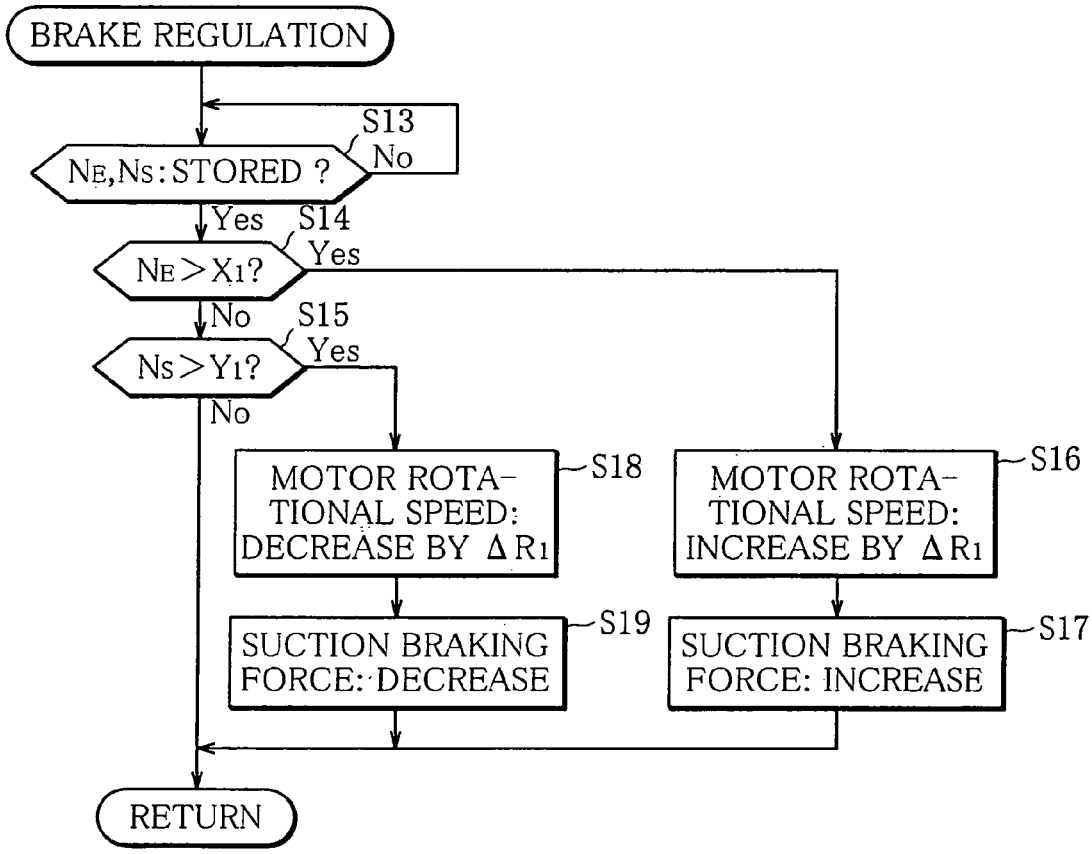
FIG. 5 is a flow chart of a regulation routine for regulating suction braking force, which is executed on the basis of a result obtained by executing the sampling routine of FIG. 4.

Specifically, the controller 38 controls the braking force according to a sampling routine and a brake regulation routine shown in FIGS. 4 and 5, respectively. Hereinafter, these routines will be described in detail.

Sampling Routine

First, the controller 38 performs an initialization process (step 1). In the initialization process, a sampling counter C, an overrun counter $N_E$ and a shortage-run counter $N_S$ are reset at 0.

Then, whether it is a detection timing or not, namely whether a receiving groove 6 that has received a rod CR has reached the detection position D or not is determined (step S2). If the result of the determination is negative (No), the controller 38 repeats step S2.

If the result of the determination is affirmative (Yes), the controller 38 reads the sensor signals $S_E$ and $S_S$ from the paired limit sensors 40 and 42 (step S3), and then whether the sensor signals $S_E$ and $S_S$ are both in an off-state or not (step S4) and whether the sensor signals $S_E$ and $S_S$ are both in an on-state or not (step S5) are determined in this order.

When the result of the determination at step S4 is affirmative, neither of the limit sensors 40 and 42 has detected the rear end part of the rod CR. This means that the cigarette rod in the receiving groove 6 has the stop position as shown with two-dotted chain lines and indicated by $CR_E$ in FIG. 3, that is, the rod $CR_E$ has moved beyond a tolerance area defined by the distance between the paired limit sensors 40 and 42 further forward, namely toward the closed end of the receiving groove 6, or in other words, overrun the tolerance area. In this situation, the controller 38 increases the value of the overrun counter $N_E$ by 1 (step S6) and sends out a removal signal (step S7).

Then the controller 38 increases the value of the sampling counter C by 1 (step S8) and determines whether the value of the sampling counter C has reached a predetermined sampling number C1 (100, for example) or not (step S9).

If the result of the determination at step S9 is negative, the above-mentioned step S2 and subsequent steps are repeated.

On the other hand, if the result of the determination at step S5 is affirmative, the limit sensors 40 and 42 have both detected the rear end part of the rod CR. This means that the cigarette rod in the receiving groove 6 has the stop position as shown with one-dotted chain lines and indicated by $CR_S$ in FIG. 3. In this case, the rod $CR_S$ has before stopped with respect to the tolerance area, or in other words, the rod $CR_3$ has stopped in the shortage-run state. In this situation, the controller 38 increases the value of the shortage-run counter $N_S$ by 1 (step S10), and sends out a removal signal (step S11). Then, step S8 is performed, and then determination at step S9 is performed.

If the result of the determination at step S4 and the result of the determination at step S5 are both negative, neither the value of the overrun counter $N_E$ nor the value of the shortage-run counter $N_S$ is increased.

The above-described sampling routine is executed repeatedly, and when the result of the determination at step S9 becomes affirmative, the controller 38 stores the value of the overrun counter $N_E$ and the value of the shortage-run counter $N_S$ in a memory (not shown) (step S12).

Brake Regulation Routine

The controller 38 executes the brake regulation routine in parallel with the sampling routine. In the brake regulation routine, the controller 38 determines whether the value of the overrun counter $N_E$ and the value of the shortage-run counter $N_S$ have been stored in the memory or not, namely the above-mentioned step S12 has been performed or not (step S13). As long as the result of the determination here stays negative, the execution of the brake regulation routine is practically suspended.

When the result of the determination at step S13 becomes affirmative, the controller 38 determines whether the value of the overrun counter $N_E$ is beyond a predetermined threshold $X_1$ (12% of C1, for example) or not (step S14) and whether the value of the shortage-run counter $N_S$ is beyond a predetermined threshold $Y_1$ (12% of C1, for example) or not (step S15), in this order.

When the result of the determination at step S14 is affirmative, it means that the ratio of the number of rods CR that have overrun the tolerance area to the number C1 of sampled rods CR is high. In this situation, the controller 38 feeds a frequency change command to the inverter 36 so that the inverter 36 will increase the motor rotational speed of the electric motor 36 by a predetermined value $\Delta R_1$ (step S16). As a result, the suction pressure supplied into the suction slot 20 by the blower 32, namely the suction braking force exerted on rods CR is increased (step S17).

Meanwhile, when the result of the determination at step S15 is affirmative, it means that the ratio of the number of rods CR that before have stopped with respect to the tolerance area to the number C1 of sampled rods CR is high. In this situation, the controller 38 feeds a frequency change command to the inverter 36 so that the inverter 36 will decrease the motor rotational speed of the electric motor 36 by a predetermined value $\Delta R_1$ (step S18). As a result, the suction braking force exerted on rods CR is decreased (step S19).

When the suction braking force is increased or decreased as described above, the stop position of rods CR take changes so as to move toward the tolerance area. Even if the stop position of rods CR comes out of the tolerance area in either direction, the stop position of rods CR is brought within the tolerance area by repeating step S17 or S19, so that the rear end of each rod CR is placed between the paired limit sensors 40 and 42.

When the stop position of a rod CR is kept within the tolerance area this way, the rod CR is then pushed from the stop position back to the normal position accurately by the above-mentioned reciprocating movement of the pusher 26, and placed at the normal position accurately. As a result, the rod CR is surely transferred from the catcher drum 2 onto the transfer drum 4. Further, since the distance that the rod CR slides in the receiving groove 6 and the distance that the rod CR is pushed back are both kept appropriate, formation of wrinkles on the wrapping paper of the rod CR is prevented.

It is to be noted that each pusher 26 functions effectively to position a rod CR only when the stop position of the rod CR is within the tolerance area or the rod CR has overrun the tolerance area. When the stop position of a rod CR has not reached the tolerance area, the function of the pusher 26 is negated.

However, as obvious from the above description, whether a rod CR has overrun the tolerance area or has run short with reference to the tolerance area, the controller 38 feeds a removal signal for the rod CR.

The removal signal is fed to a removal device (not shown). The removal device is arranged downstream of the catcher drum 2. On the basis of the removal signal from the controller 38, the removal device can remove a defective rod CR of which the stop position was out of the tolerance area, or a double filter cigarette or filter cigarettes formed from the defective rod CR, from the conveying path.

Figure 6:
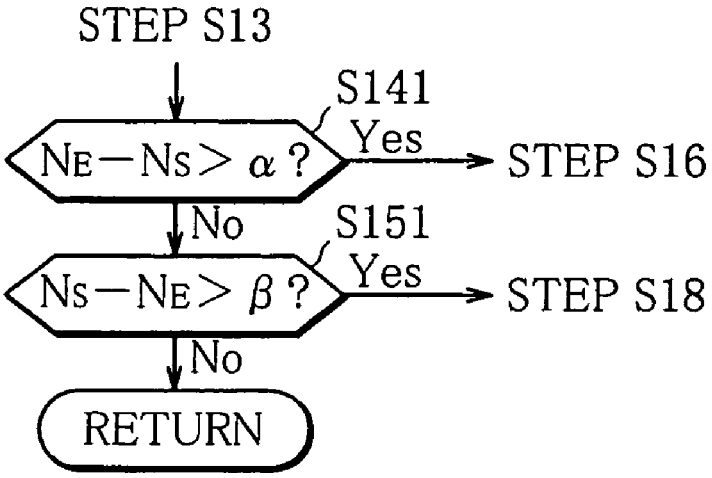
FIG. 6 is a flow chart of a variant of the regulation routine of FIG. 5.

In the above embodiment, at steps S14 and S15, the value of the overrun counter $N_E$ and the value of the shortage-run counter $N_S$ are compared with the thresholds $X_1$ and $Y_1$, respectively. These steps S14 and S15 can be replaced with steps S141 and S151 shown in FIG. 6. At step S141, whether the difference obtained by subtracting the value of the shortage-run counter $N_S$ from the value of the overrun counter $N_E$ is beyond a (3% of C1, for example) or not is determined. At step S151, whether the difference obtained by subtracting the value of the overrun counter $N_E$ from the value of the shortage-run counter $N_S$ is beyond β (3% of C1, for example) or not is determined. From the results of the comparisons at steps S141 and S151, the controller 38 can also determine in which direction the stop position of rods CR is out of the tolerance area.

While in the above embodiment, the stop position of rods CR is detected only with the paired limit sensors 40 and 42, a pair of intermediate sensors 44, 46 can be added to the limit sensors 40 and 42. Like the paired limit sensors 40 and 42, the intermediate sensors 44 and 46 are reflective optical sensors.

Figure 7:
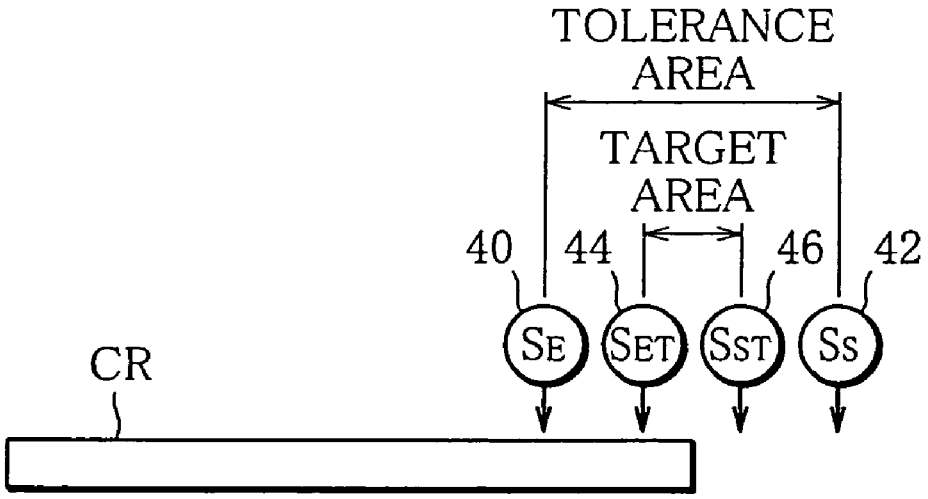
FIG. 7 is an illustration showing how pairs of limit sensors and intermediate sensors are arranged.

As shown in FIG. 7, the paired intermediate sensors 44 and 46 are arranged between the paired limit sensors 40 and 42 (within the tolerance area). The intermediate sensors 44 and 46 define a target area in which each rod R should be located when the rod is stopped. That is, the intermediate sensors 44 and 46 detect the rear end part of a rod CR and sends out sensor signals $S_{ET}$ and $S_{ST}$ according to the result of the detection.

Figure 8:
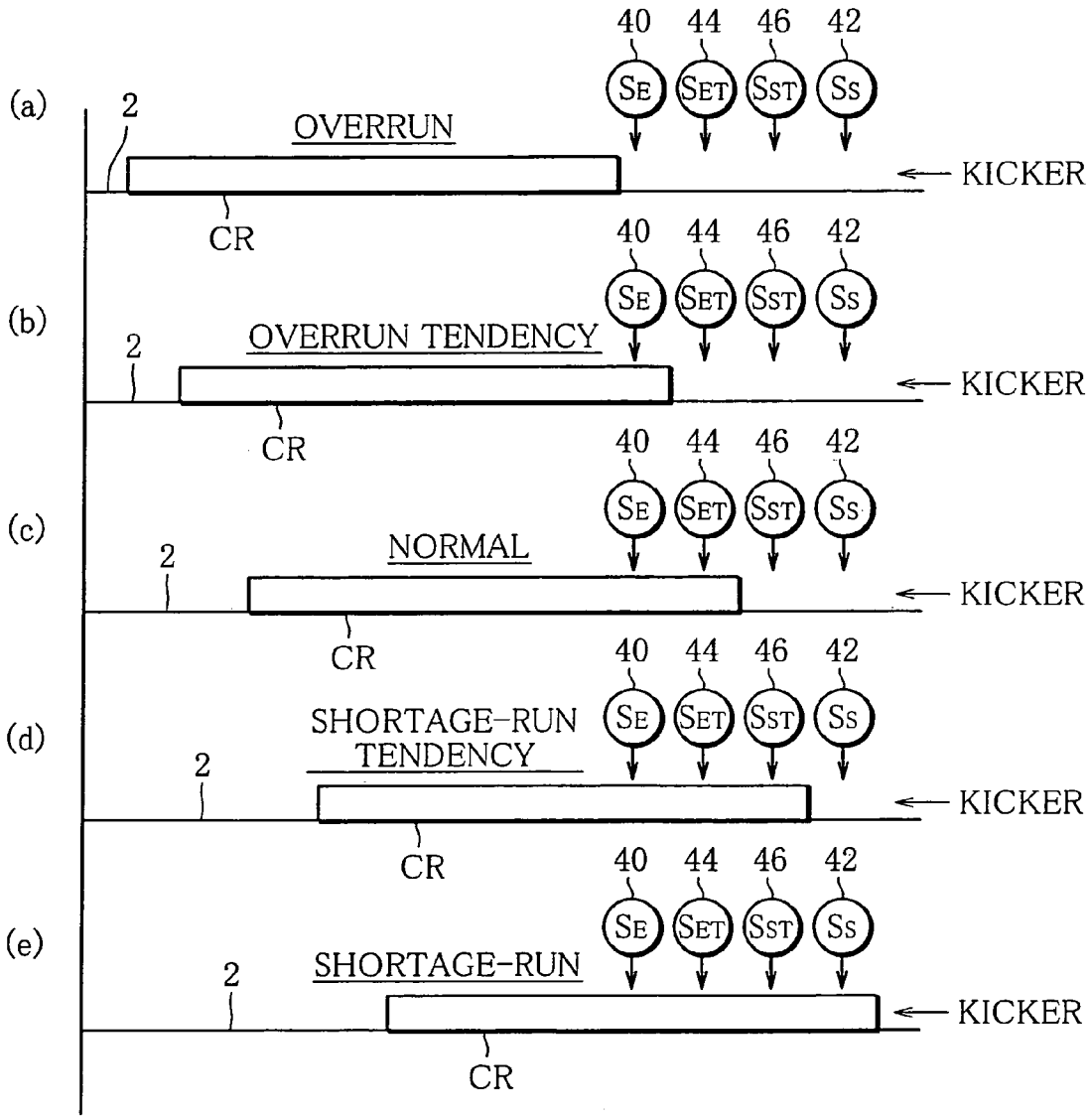
FIG. 8 is an illustration showing examples of positions at which a cigarette rod is stopped, detectable by the limit sensors and intermediate sensors.

In this case, on the basis of the sensor signals from the paired limit sensors 40 and 42 and the paired intermediate sensors 44 and 46, the controller 38 classifies the stop position of a rod CR into five states (a) to (e) shown in FIG. 8, and finely regulates the suction braking force exerted on rods CR.

Figure 9:
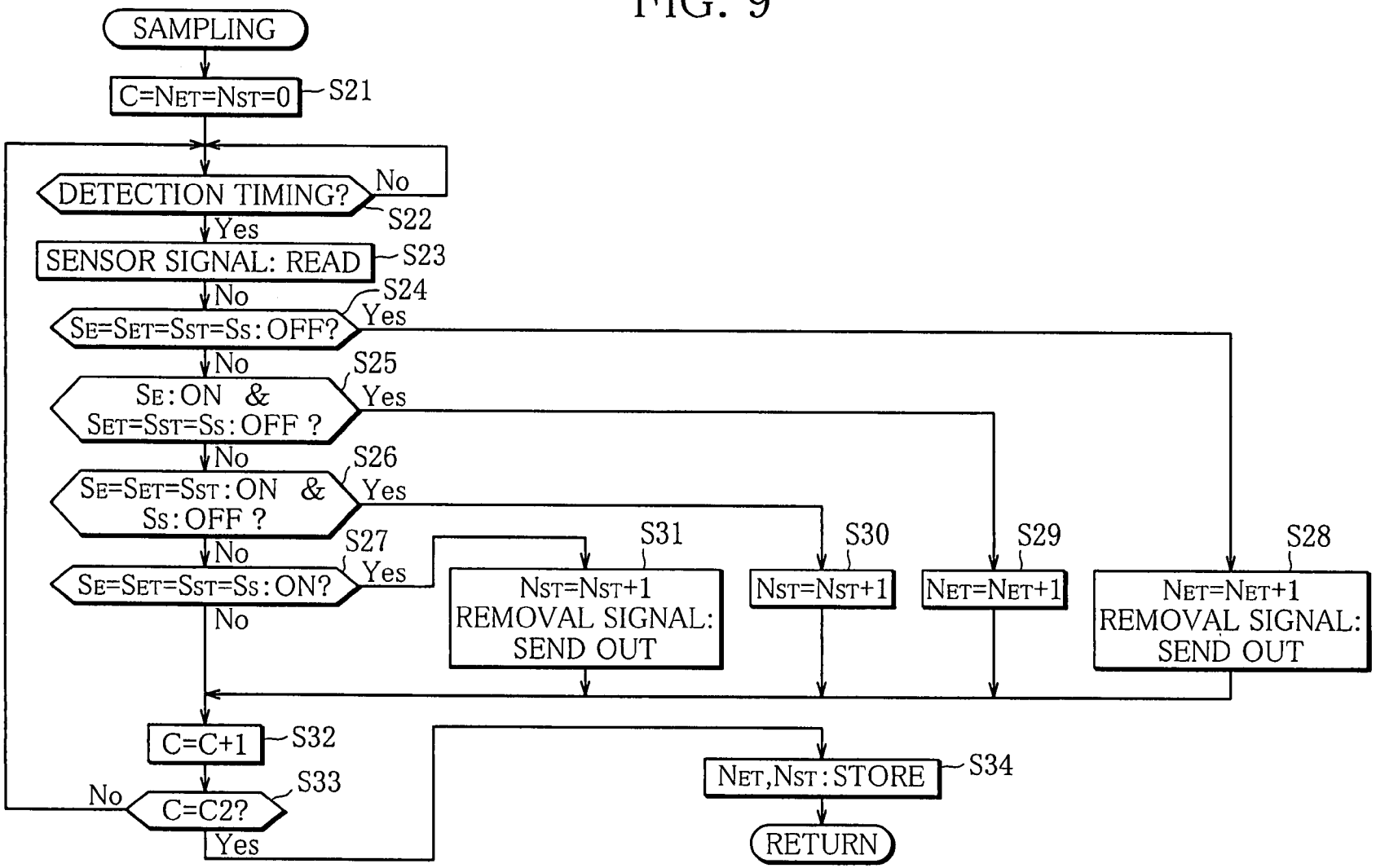
FIG. 9 is a flow chart of a sampling routine using the intermediate sensors.
Figure 10:
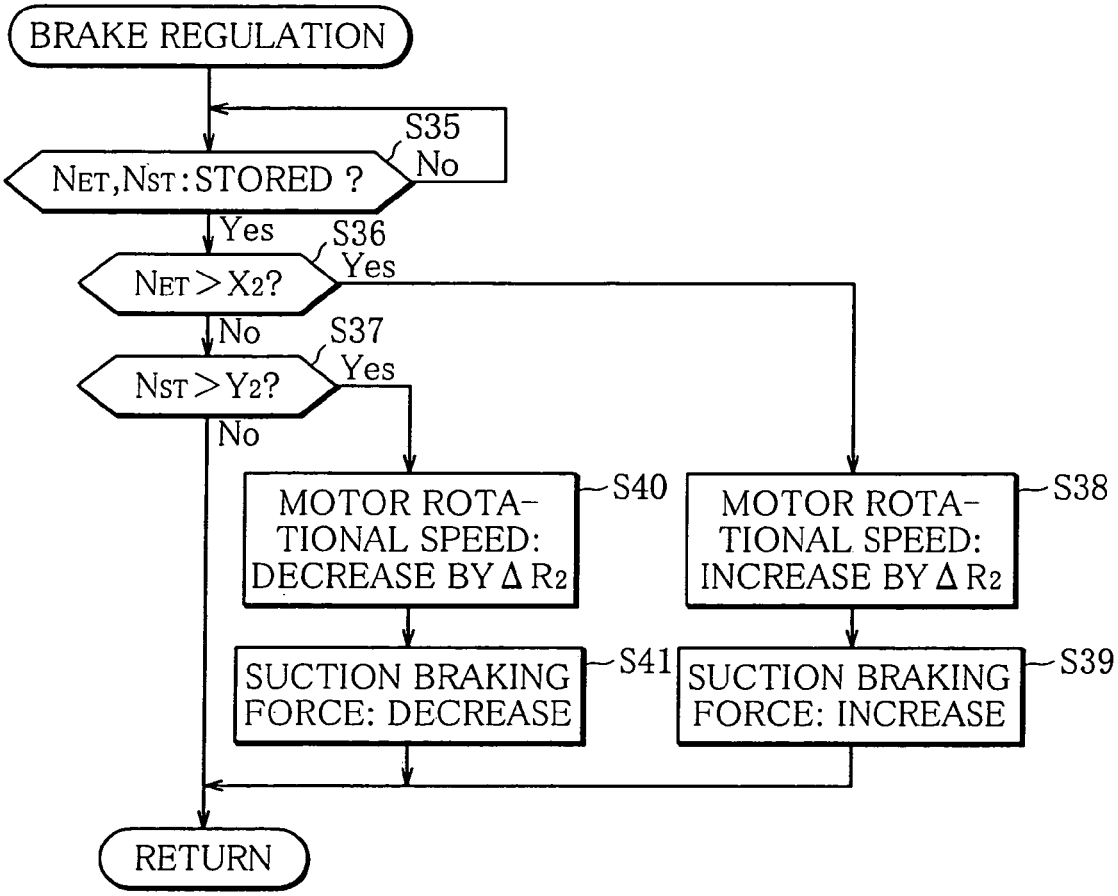
FIG. 10 is a flow chart of a regulation routine for regulating suction braking force, which is executed on the basis of a result obtained by executing the sampling routine of FIG. 9.

Specifically, the controller 38 executes a sampling routine shown in FIG. 9 and a brake regulation routine shown in FIG. 10 in parallel.

Sampling Routine

Also in this sampling routine, the controller 38 first performs an initialization process. In the initialization process, a sampling counter C, an overrun tendency counter $N_{ET}$ and a shortage-run tendency counter $N_{ST}$ are reset at 0 (step S21).

Then, at a detection timing (step S22), the controller 38 reads sensor signals $S_E$, $S_{ET}$, $S_{ST}$ and $S_S$ from the above-mentioned four sensors 40 to 46 (step S23).

The controller 38 determines whether or not the sensor signals $S_E$, $S_{ET}$, $S_{ST}$ and $S_S$ are all in an off-state (step S24), whether or not the sensor signals $S_E$ is in an on-state and the sensor signals $S_{ET}$, $S_{ST}$ and $S_S$ are in an off-state (step S25), whether or not the sensor signals $S_E$, $S_{ET}$, and $S_{ST}$ are in an on-state and the sensor signal $S_S$ is in an off-state (step S26), and whether or not the sensor signals $S_E$, $S_{ET}$, $S_{ST}$ and $S_S$ are all in an on-state (step S27), in this order.

When the result of the determination at step S24 is affirmative, the stop position of a rod CR is as shown in (a) of FIG. 8, namely, the rod CR has overrun the tolerance area and stopped. In this situation, the controller 38 increases the value of the overrun tendency counter $N_{ET}$ by 1 and sends out a removal signal (step S28).

When the result of the determination at step S25 is affirmative, the stop position of a rod CR is as shown in (b) of FIG. 8. Thus, the stop position of the rod CR is within the tolerance area, but the rod has overrun the target area. Also in this situation, the controller 38 increases the value of the overrun tendency counter $N_{ET}$ by 1 (step S29).

When the result of the determination at step S26 is affirmative, the stop position of a rod CR is as shown in (d) of FIG. 8. Thus, the stop position of the rod CR is within the tolerance area, but the rod has run short with reference to the target area. In this situation, the controller 38 increases the value of the shortage-run tendency counter $N_{ST}$ by 1 (step S30).

When the result of the determination at step S27 is affirmative, the stop position of a rod CR is as shown in (e) of FIG. 8. Thus, the rod CR has run short with reference to the tolerance area and stopped. In this situation, the controller 38 increases the value of the shortage-run tendency counter $N_{ST}$ by 1 and feeds a removal signal (step S31).

It is to be noted that when the results of the determinations at step S24 to S27 are all negative, the stop position of a rod CR is as shown in (c) of FIG. 8, namely within the target area.

Then the controller 38 increases the value of the sampling counter C by 1 (step S32) and determines whether the value of the sampling counter C has reached a predetermined sampling number C2 (100, for example) or not (step S33). If the result of the determination at step S33 is negative, the above-mentioned step S22 and subsequent steps are repeated.

The above-described sampling routine is executed repeatedly, and when the result of the determination at step 33 becomes affirmative, the controller 38 stores the value of the overrun tendency counter $N_{ET}$ and the value of the shortage-run tendency counter $N_{ST}$ in a memory (not shown) (step S34).

Brake Regulation Routine

The execution of the brake regulation routine is suspended until the value of the overrun tendency counter $N_{ET}$ and the value of the shortage-run tendency counter $N_{ST}$ are stored (step S35).

Then, when the result of the determination at step S35 becomes affirmative, the controller 38 determines whether the value of the overrun tendency counter $N_{ET}$ is larger than a predetermined threshold $X_2$ (6% of C2, for example) or not (step S36) and whether the value of the shortage-run tendency counter $N_{ST}$ is larger than a predetermined threshold $Y_2$ (6% of C2, for example) or not (step S37), in this order.

When the result of the determination at step S36 is affirmative, it means that rods CR tend to overrun the target area and stop. In this case, the controller 38 increases the motor rotational speed of an electric motor 34 by a predetermined value $\Delta R_2$ by means of an inverter 36 (step S38), to thereby increase the suction braking force exerted on rods CR (step S39).

On the other hand, when the result of the determination at step S37 is negative, it means that rods CR tend to run short with reference to the target area and stop. In this case, the controller 38 decreases the motor rotational speed of the electric motor 34 by a predetermined value $\Delta R_2$ by means of the inverter 36 (step S40), to thereby decrease the suction braking force exerted on rods CR (step S41).

Thus, by repeating step S39 or S41, the controller 38 can keep the stop position of rods CR within the target area in the tolerance area.

In the brake regulation routine of FIG. 10, the controller 38 increases or decreases the suction braking force on the basis of the value of the overrun tendency counter $N_{ET}$ or the value of the shortage-run tendency counter $N_{ES}$. This makes it possible to regulate the suction braking force without causing removal of so many rods CR, compared with the routine of FIG. 5.

The present invention is not limited to the above-described embodiments. Various modifications can be made to these embodiments.

For example, also in the brake regulation routine of FIG. 10, the suction braking force can be regulated on the basis of comparison between the value of the overrun tendency counter $N_{ET}$ and the value of the shortage-run tendency counter $N_{ES}$.

When the paired limit sensors 40 and 42 and the paired intermediate sensors 44 and 46 are arranged as shown in FIGS. 7 and 8, all of these sensors detect the rear end part of each rod CR. However, when the limit sensors and the intermediate sensors are so arranged that one limit sensor and one intermediate sensor are located on each side of a rod CR, the sensors on one side and the sensors on the other side can detect the front end part and the rear end part of the rod, respectively.

When the above-described means for pushing back rods CR, or positioning rods CR, which includes the pushers 26 and the cam mechanism, is provided to the catcher drum 2, at least the limit sensor 42 can be arranged over the transfer drum 4 instead of the catcher drum.

Figure 11:
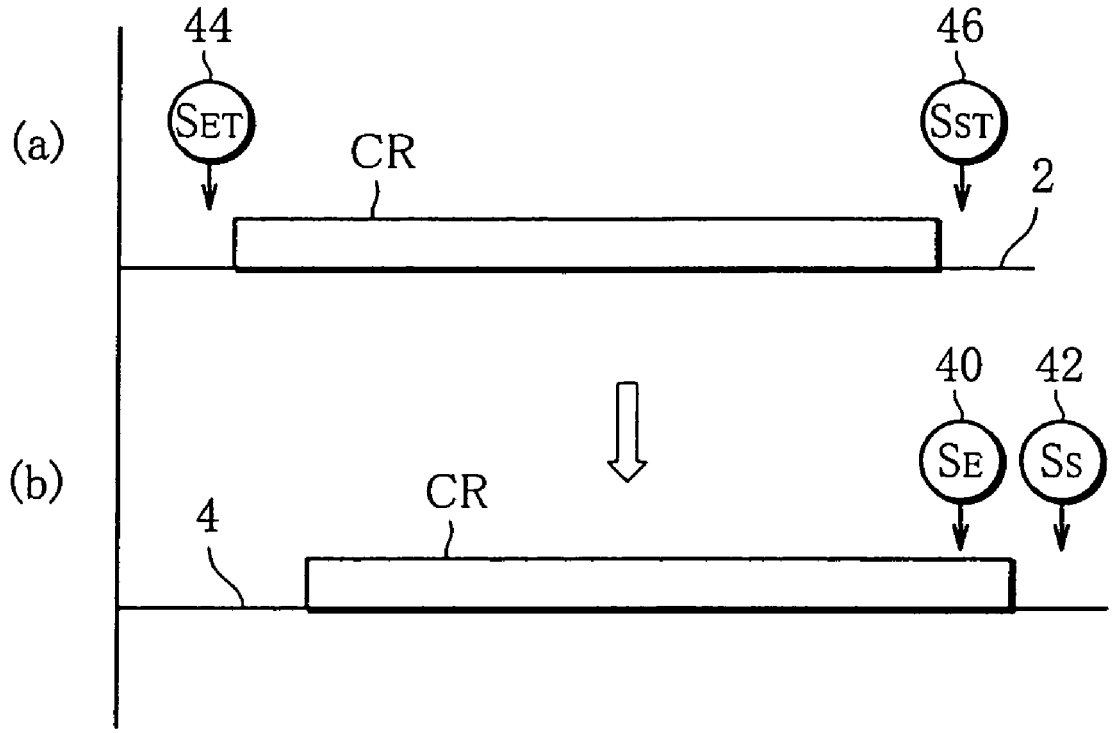
FIG. 11 is an illustration showing a variant of the arrangement of pairs of limit sensors and intermediate sensors.

In contrast, when the means for positioning rods CR is provided not to the catcher drum 2 but to the transfer drum 4, it can be so arranged that the paired intermediate sensors 44 and 46 are located over the catcher drum 2 to detect the opposite ends of each rod CR, while the paired limit sensors 40 and 42 are located over the transfer drum 4 to detect the rear end of each rod CR, as shown in FIG. 11. In this case, each rod CR is pushed back to the normal position by a pusher of the positioning means after detected by the limit sensors 40 and 42. Thus, in carrying out the present invention, the arrangement of the limit sensors 40 and 42 and the intermediate sensors 44 and 46 is not restricted.

Further, the limit sensors and the intermediate sensors are not limited to reflective optical sensors. Various optical sensors can be used for these sensors. Further, the suction braking force can be regulated not only by changing the rotational speed of the blower but also by regulating the opening of an electromagnetic throttle valve provided between the blower and the suction slot. Thus, the manner of regulating the suction braking force is not restricted.

Last, the rod member receiving apparatus according to the present invention can be applied to not only the filter cigarette making machine but also various machines that carry and work on rod members.

The invention claimed is:

1. A receiving apparatus for receiving rod members carried in a direction parallel to their axes and carrying the received rod members in a direction crossing their axes along a predetermined conveying path, comprising:

a catcher drum forming a beginning end of the conveying path and rotatable in one direction, said catcher drum having a plurality of receiving grooves in an outer circumferential surface thereof, arranged in the circumferential direction of said catcher drum at regular intervals, and a receiving position defined at a predetermined position in the circumferential direction of said catcher drum and to which rod members are fed, the receiving grooves being so designed as to each receive a rod member at the receiving position when said catcher drum rotates and the receiving grooves pass the receiving position one after another, and allow the received rod member to move forward in the receiving groove;

braking means for stopping the forward movement of a rod member in each of the receiving grooves, said braking means including braking areas each defined at an bottom of one of the receiving grooves to apply a predetermined braking force due to suction onto the rod member when the rod member enters the braking area;

detection means for detecting whether a stop position at which the rod member is stopped in each of the receiving grooves is within a tolerance area or not, and feeding a result of detection;

control means for regulating the braking force by said braking means on the basis of the result of detection to thereby control the stop position of rod members; and positioning means for, after the rod member is stopped in each of the receiving grooves, pushing the rod member from the stop position back to a normal position, in the direction opposite to the direction of the forward movement of the rod member, on the conveying path.

2. The receiving apparatus according to claim 1, wherein said detection means includes a pair of limit sensors arranged outside the catcher drum for optically detecting a rod member, the limit sensors being apart from each other in the direction of the forward movement of a rod member and defining the tolerance area.

3. The receiving apparatus according to claim 2, wherein the paired limit sensors are arranged to detect an end part of a rod member and each send out a sensor signal.

4. The receiving apparatus according to claim 3, wherein said control means comprises:

reading means for reading the sensor signals from the paired limit sensors, determination means for determining whether the stop position of the rod member is within the tolerance area or not, on the basis of the sensor signals, means for sending out a removal signal for removing a rod member from the conveying path, on the basis of the result of determination by said determination means, sampling means for sampling and classifying results of determination by said determination means, and regulation means for increasing or decreasing the braking force exerted on rod members on the basis of the result of classification by said sampling means, each time the number of sampled results reaches a predetermined value.

5. The receiving apparatus according to claim 2, wherein said detection means further includes a pair of intermediate sensors arranged outside said catcher drum for optically detecting a rod member, the intermediate sensors being apart from each other in the direction of the forward movement of the rod member and defining, within the tolerance area, a target area in which the rod member should be stopped.

6. The receiving apparatus according to claim 5, wherein said control means comprises:

reading means for reading sensor signals from the paired limit sensors and the paired intermediate sensors;

first determination means for determining whether the stop position of the rod member is within the tolerance area or not, on the basis of the signals from the paired limit sensors;

means for sending out a removal signal for removing a rod member from the conveying path, on the basis of a result of determination by said first determination means, second determination means for determining whether the stop position of the rod member is within the target area or not, on the basis of the signals from the paired intermediate sensors;

sampling means for sampling and classifying the results of determination by said first and second determination means, and regulation means for increasing or decreasing the braking force exerted on rod members on the basis of the result of classification by said sampling means, each time the number of sampled results reaches a predetermined value.

7. The receiving apparatus according to claim 1, wherein the braking areas of said braking means each have a plurality of suction holes open at an bottom of each receiving grooves, to which suction pressure is supplied, the plurality of suction holes being distributed in direction of the forward movement of the rod member.

8. The receiving apparatus according to claim 7, wherein said catcher drum further comprises assist means for assisting the rod member to move forward in each of the receiving grooves.

9. The receiving apparatus according to claim 8, wherein said assist means generates a flow of air flowing in the direction of the forward movement of the rod member, in each of the receiving grooves.

* * * * *